US008051504B1

(12) United States Patent
Folds

(10) Patent No.: US 8,051,504 B1
(45) Date of Patent: Nov. 8, 2011

(54) PORTABLE SEAT DEVICE

(76) Inventor: Stephen C. Folds, Vero Beach, FL (US)

( * ) Notice: Subject to any disclaimer, the term of this patent is extended or adjusted under 35 U.S.C. 154(b) by 358 days.

(21) Appl. No.: 12/354,672

(22) Filed: Jan. 15, 2009

(51) Int. Cl.
*A47K 13/00* (2006.01)

(52) U.S. Cl. ..... 4/239; 4/254

(58) Field of Classification Search ..... 4/239, 254, 4/460, 479–484, 560.1; 297/250.1, 252, 297/188.2, 440.24
See application file for complete search history.

(56) References Cited

U.S. PATENT DOCUMENTS

| | | | | |
|---|---|---|---|---|
| 1,419,947 | A | 6/1922 | Schouten | |
| 1,687,038 | A * | 10/1928 | Pettigrew | 297/252 |
| 3,950,794 | A | 4/1976 | Dalton | |
| 4,359,791 | A * | 11/1982 | Thomas | 4/546 |
| 4,962,551 | A | 10/1990 | Bly | |
| 5,230,105 | A | 7/1993 | Watson | |
| D377,971 | S | 2/1997 | Vanakkeren et al. | |
| 5,778,460 | A | 7/1998 | Doell et al. | |
| 5,876,091 | A | 3/1999 | Chernomashentsev | |
| 5,920,917 | A * | 7/1999 | Landsberger | 4/235 |
| 6,000,068 | A * | 12/1999 | Chavis | 4/244.3 |
| 6,039,403 | A * | 3/2000 | Hargroder | 297/440.24 |
| 6,647,560 | B1 | 11/2003 | Hingley et al. | |
| 6,655,630 | B2 | 12/2003 | Newman et al. | |
| 2005/0066430 | A1 * | 3/2005 | Bly | 4/254 |
| 2007/0074338 | A1 * | 4/2007 | List | 4/483 |

* cited by examiner

*Primary Examiner* — Charles Phillips

(57) ABSTRACT

A portable seat device for use in a portable restroom comprising a seat having an opening situated atop a frame, the frame having a front left leg, a front right leg, a rear left leg, and a rear right leg; a right side horizontal bar connecting the top end of the front right leg to the top end of the rear right leg, and a left side horizontal bar connecting the top end of the front left leg to the top end of the rear left leg. The length of the rear legs, as measured from the top end to the bottom end, are less than the length of the front legs, as measured from the top end to the bottom end.

8 Claims, 5 Drawing Sheets

PORTABLE SEAT DEVICE

FIELD OF THE INVENTION

The present invention is directed to a portable seat for use in a portable restroom.

BACKGROUND. OF THE INVENTION

The present invention provides a user with a clean area on which to sit when the need to use a portable restroom arises. It provides a more sanitary alternative to sitting on the seats within portable restroom enclosures.

The present invention features a portable seat device for use in a portable restroom. The portable seat device comprises a seat having an opening situated atop a frame having a front left leg, a front right leg, a rear left leg, and a rear right leg. The frame further comprises a right side horizontal bar and a left side horizontal bar. The frame forms a chair-like configuration.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
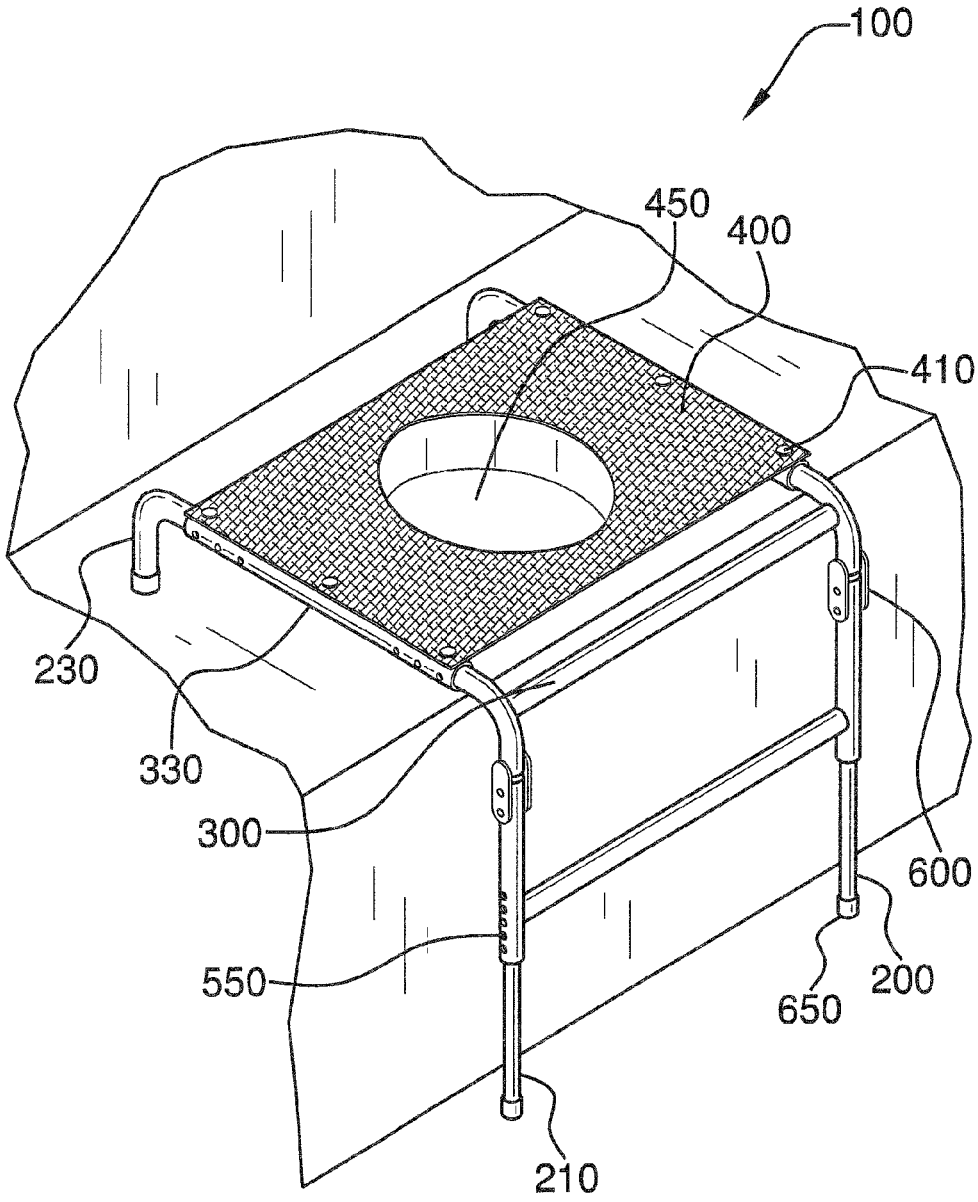
FIG. 1 is a perspective view of the portable seat device of the present invention as used in a portable restroom.

The following is a listing of numbers corresponding to a particular element refer to herein:

100 portable seat device
200 front right leg
210 front left leg
220 rear right leg
230 rear left leg
250 bottom leg portion
260 top leg portion
300 front horizontal bar
310 rear horizontal bar
320 right horizontal bar
330 left horizontal bar
400 seat
410 attachment means
450 seat opening
500 spring-loaded button
550 aperture
600 hinge mechanism
650 rubber stopper

Figure 2:
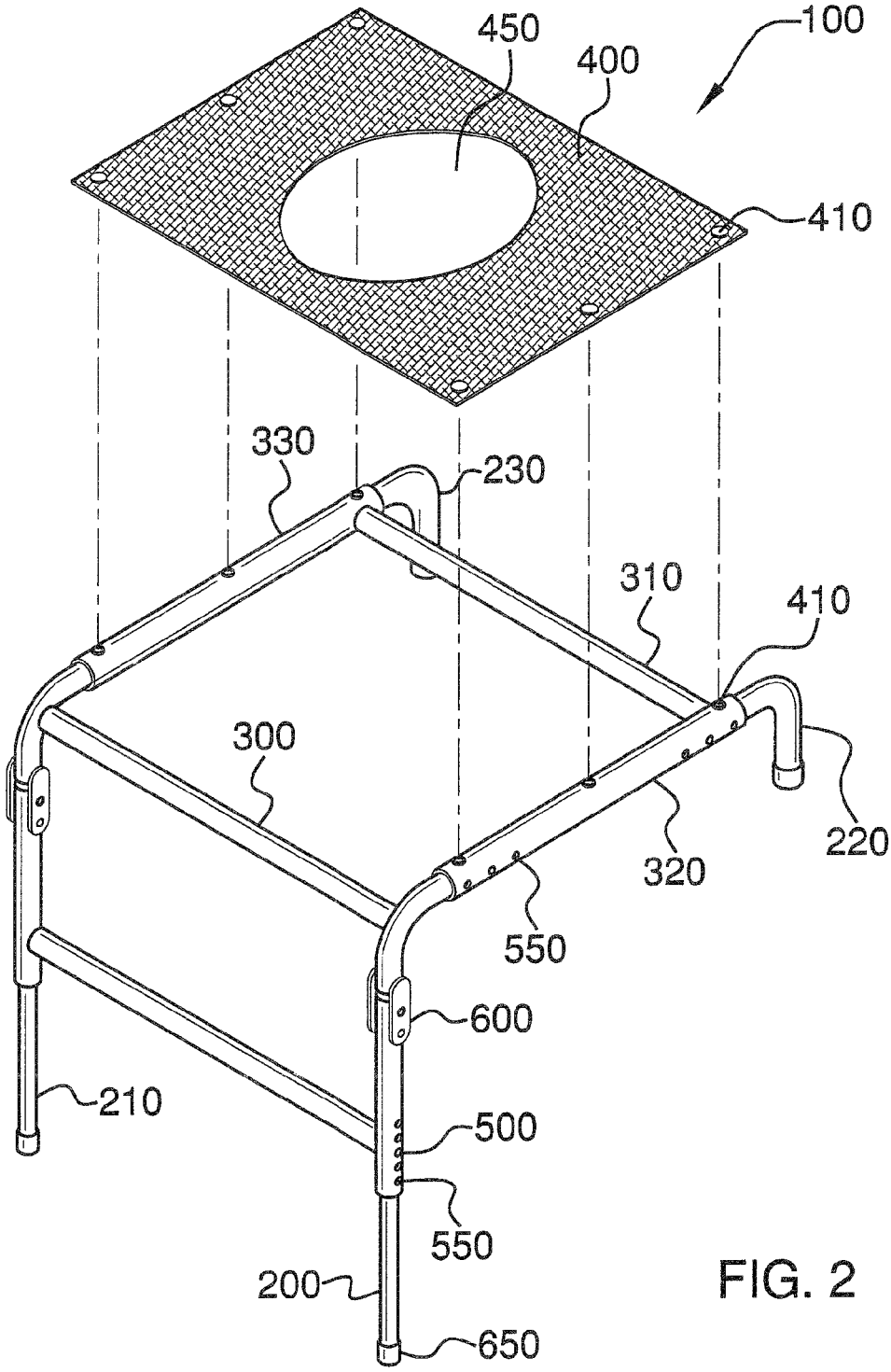
FIG. 2 is a perspective view of the portable seat device of the present invention.
Figure 3:
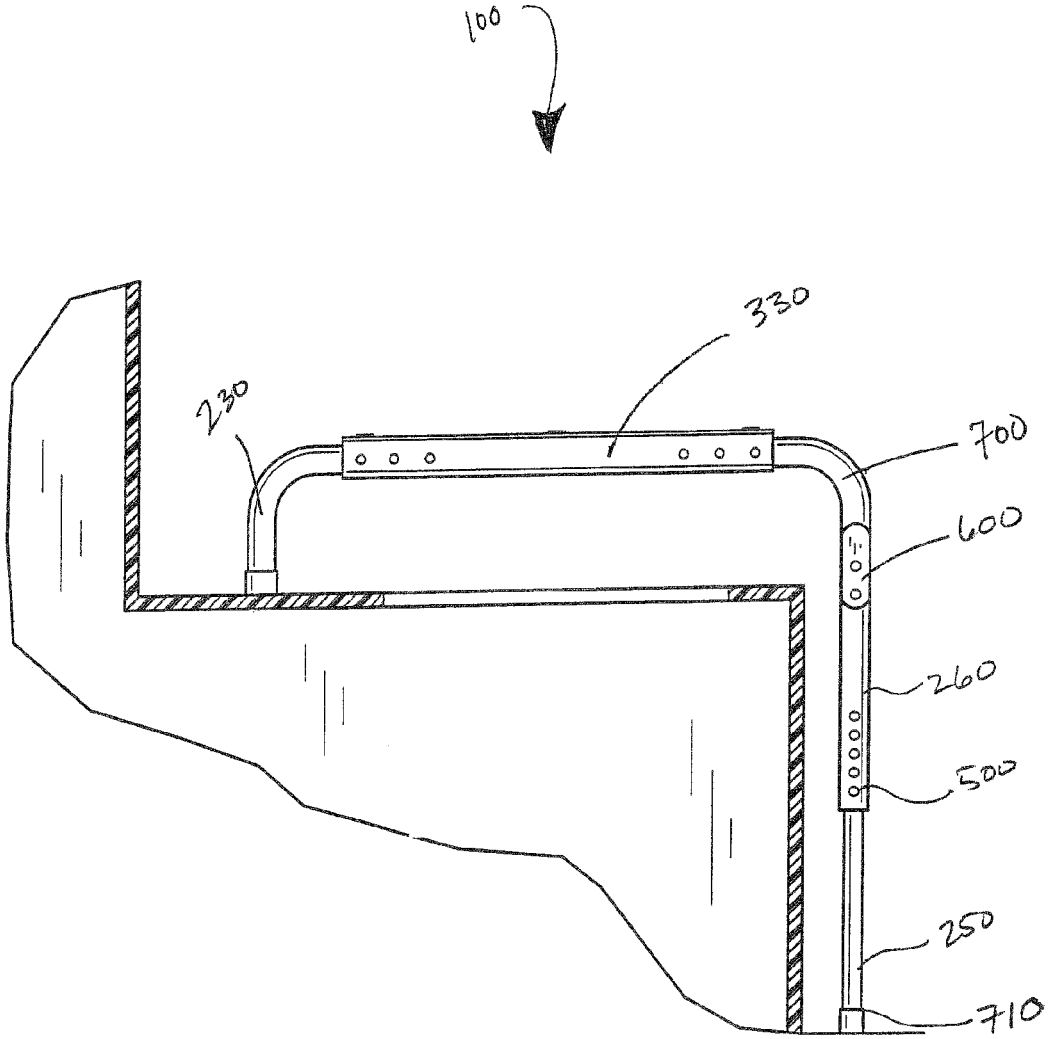
FIG. 3 is a side view of the portable seat device of the present invention.
Figure 4:
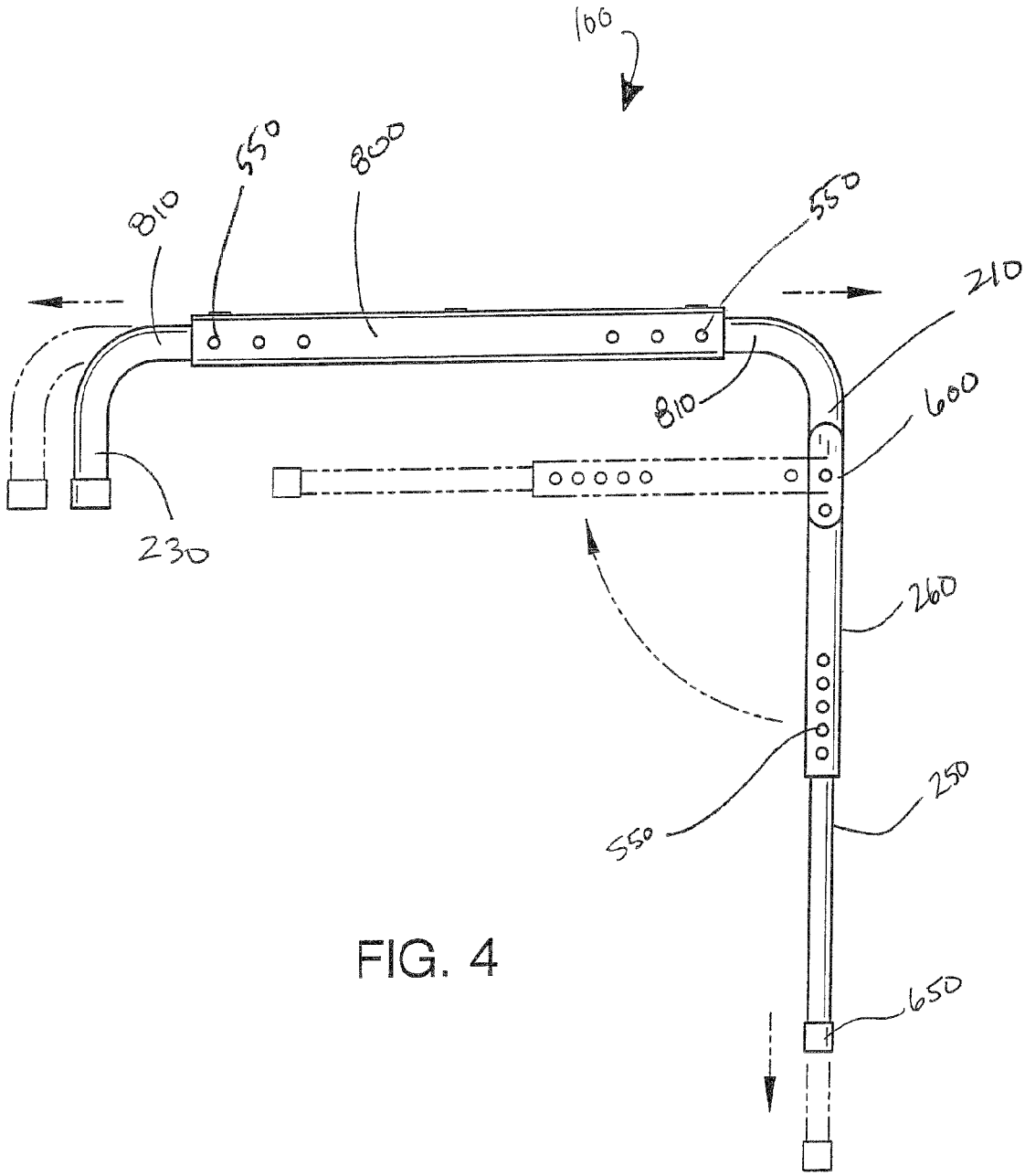
FIG. 4 is a side view of the portable seat device of the present invention illustrating how the rear legs and the front legs are adjustable and collapsible.
Figure 5:
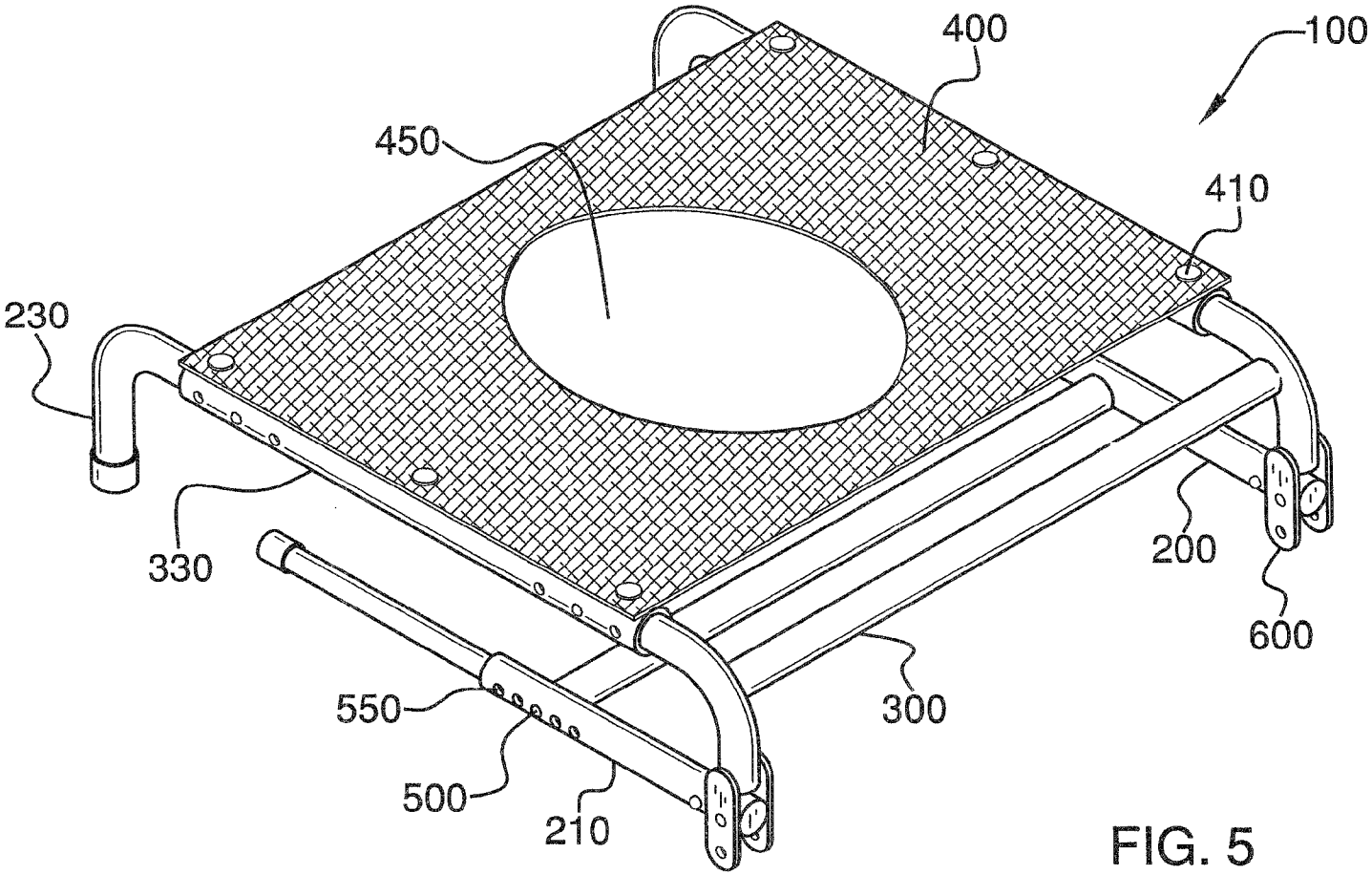
FIG. 5 is a perspective view of the portable seat device of the present invention illustrating the portable seat device in its collapsed configuration for storing.

700 top end of leg
710 bottom end of leg
800 outer portion
810 inner portion Referring now to FIGS. 1-5, the present invention features a portable seat device 100 for use in a portable restroom. The portable seat device 100 comprises a seat 400 having an opening 450 situated atop a frame having a front right leg 200, a front left leg 210, a rear right leg 220, and a rear left leg 230. Each leg has a top end and a bottom end.

A left side horizontal bar 330 connects the top end of the front left leg 210 to the top end of the rear left leg 230. A right side horizontal bar 320 connects the top end of the front right leg 200 to the top end of the rear right leg 220. A front horizontal bar 300 connects the top end of the front right leg 200 to the top end of the front left leg 210. A rear horizontal bar 310 connects the right horizontal bar 320 to the left horizontal bar 330.

The frame forms chair-like configuration. The length of the rear legs, as measured from the top end to the bottom end, are less than the length of the front legs, as measured from the top end to the bottom end. In some embodiments, the seat 400 is attached to the left horizontal bar 330 and the right horizontal bar 320 of the frame via an attachment means 410.

In some embodiments, each front leg features a two-piece adjustable design, wherein each leg comprises a tubular bottom leg portion 250 for inserting into a hollow tubular top leg portion 260. The purpose of the 2-piece telescoping design is for enabling the length of the front legs to be adjusted. Disposed along the top leg portion 260 is a plurality of apertures 550. Disposed on the bottom leg portion 250 is a spring-loaded button 500 for inserting into an aperture 550 disposed on the top leg portion 260. The height of the front legs may be adjusted by inserting the spring-loaded button 500 into various apertures 550 disposed on the top leg portion 250.

In some embodiments, the left side horizontal bar 330 and the right side horizontal bar 320 each feature a two-piece adjustable design, wherein the horizontal bars comprise a tubular inner portion 810 for inserting into a hollow tubular outer portion 800. The purpose of the telescoping design is for enabling the length of the horizontal bars to be adjusted. Disposed along the outer portion 800 is a plurality of apertures 550. Disposed on the inner portion 810 is a spring-loaded button 500 for inserting into an aperture 550 disposed on the outer portion 800. The length of the horizontal bars may be adjusted by inserting the spring-loaded button 500 into various apertures 550 disposed on the outer portion 800.

In some embodiments, the front legs may be folded underneath the horizontal bars via a hinge mechanism 600 disposed near the top of the front legs. The hinge mechanism 600 is for allowing the portable seat device 100 to be folded into a collapsed configuration for storage when the portable seat device 100 is not in use.

In some embodiments, a rubber stopper 650 is disposed on the bottom end of each leg. The stopper 650 is for helping to secure the portable seat device 100 to the floor of the portable restroom and/or the seat of the portable toilet and prevent the device 100 from slipping and/or sliding.

The portable seat device 100 of the present invention may be constructed from a variety of materials. In some embodiments, the portable seat device 100 is constructed from a material comprising a metal (e.g., aluminum), a plastic, the like, or a combination thereof. In some embodiments, the seat is constructed from a material comprising a cotton, a nylon, the like, or a combination thereof.

As used herein, the term "about" refers to plus or minus 10% of the referenced number. For example, an embodiment wherein the front leg is about 30 inches long includes a front leg that is between 27 and 33 inches long.

The portable seat device 100 of the present invention may be constructed in a variety of sizes. In some embodiments, the left front leg and/or the right front leg is between about 10 to 15 inches in length as measured from the top end to the bottom end. In some embodiments, the left front leg and/or the right front leg is between about 15 to 20 inches in length as measured from the top end to the bottom end. In some embodiments, the left front leg and/or the right front leg is between about 20 to 30 inches in length as measured from the top end to the bottom end. In some embodiments, the left front leg and/or the right front leg is between about 30 to 40 inches in length as measured from the top end to the bottom end.

In some embodiments, the left rear leg and/or the right rear leg is between about 1 to 5 inches in length as measured from the top end to the bottom end. In some embodiments, the left rear leg and/or the right rear leg is between about 5 to 10 inches in length as measured from the top end to the bottom end. In some embodiments, the left rear leg and/or the right rear leg is between about 10 to 15 inches in length as measured from the top end to the bottom end. In some embodiments, the left rear leg and/or the rear front leg is between about 15 to 20 inches in length as measured from the top end to the bottom end.

In some embodiments, the left front leg and the right front leg are each between about 10 to 15 inches in length as measured from the top end to the bottom end and the left rear leg and the right rear leg are each between about 1 to 5 inches in length as measured from the top end to the bottom end. In some embodiments, the left front leg and the right front leg are each between about 15 to 20 inches in length as measured from the top end to the bottom end and the left rear leg and the right rear leg are each between about 1 to 5 inches in length as measured from the top end to the bottom end. In some embodiments, the left front leg and the right front leg are each between about 20 to 30 inches in length as measured from the top end to the bottom end and the left rear leg and the right rear leg are each between about 1 to 5 inches in length as measured from the top end to the bottom end. In some embodiments, the left front leg and the right front leg are each between about 30 to 40 inches in length as measured from the top end to the bottom end and the left rear leg and the right rear leg are each between about 1 to 5 inches in length as measured from the top end to the bottom end.

In some embodiments, the left front leg and the right front leg are each between about 10 to 15 inches in length as measured from the top end to the bottom end and the left rear leg and the right rear leg are each between about 5 to 10 inches in length as measured from the top end to the bottom end. In some embodiments, the left front leg and the right front leg are each between about 15 to 20 inches in length as measured from the top end to the bottom end and the left rear leg and the right rear leg are each between about 5 to 10 inches in length as measured from the top end to the bottom end. In some embodiments, the left front leg and the right front leg are each between about 20 to 30 inches in length as measured from the top end to the bottom end and the left rear leg and the right rear leg are each between about 5 to 10 inches in length as measured from the top end to the bottom end. In some embodiments, the left front leg and the right front leg are each between about 30 to 40 inches in length as measured from the top end to the bottom end and the left rear leg and the right rear leg are each between about 5 to 10 inches in length as measured from the top end to the bottom end.

In some embodiments, the left front leg and the right front leg are each between about 10 to 15 inches in length as measured from the top end to the bottom end and the left rear leg and the right rear leg are each between about 10 to 20 inches in length as measured from the top end to the bottom end. In some embodiments, the left front leg and the right front leg are each between about 15 to 20 inches in length as measured from the top end to the bottom end and the left rear leg and the right rear leg are each between about 10 to 20 inches in length as measured from the top end to the bottom end. In some embodiments, the left front leg and the right front leg are each between about 20 to 30 inches in length as measured from the top end to the bottom end and the left rear leg and the right rear leg are each between about 10 to 20 inches in length as measured from the top end to the bottom end. In some embodiments, the left front leg and the right front leg are each between about 30 to 40 inches in length as measured from the top end to the bottom end and the left rear leg and the right rear leg are each between about 10 to 20 inches in length as measured from the top end to the bottom end.

Example 1

Use of the Portable Seat Device

The following example describes the use of the portable seat device 100 of the present invention. A user wishing to use a portable restroom first unfolds the portable seat device 100 from its compacted configuration (e.g., the user unfolds the front legs via the hinge mechanism) and places the rear legs behind the toilet seat and the front legs on the floor of the portable restroom enclosure. Next, the user adjusts the front legs to an appropriate length so that they rest firmly on the floor of the portable restroom enclosure. After the portable seat device 100 is secured and leveled, the user sits on the seat to relieve himself while the portable seat device 100 keeps his posterior and legs raised off of the portable toilet seat for increased sanitation. The seat opening in the middle of the seat allows the user's excrement to deposit into the portable toilet. After the user is finished, he stands up, collapses the portable seat device 100 into its compacted configuration for storage (see FIGS. 4-5) by folding the front legs underneath the horizontal bars via the hinge mechanism.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A portable seat device for use in a portable restroom comprising:

(a) a frame having:

(i) a front right leg having a top end and a bottom end;

(ii) a front left leg having a top end and a bottom end;

(iii) a rear right leg having a top end and a bottom end;

(iv) a rear left leg having a top end and a bottom end;

(v) a right side horizontal bar connecting the top end of the front right leg to the top end of the rear right leg, the length of said right side horizontal bar being adjustable;

(vi) a left side horizontal bar connecting the top end of the front left leg to the top end of the rear left leg, the length of said right side horizontal bar being adjustable;

(vii) a front horizontal bar connecting the top end of the front left leg to the top end of the front right leg; and (viii) a rear horizontal bar connecting the left side horizontal bar to the right side horizontal bar; wherein frame forms a chair-like configuration; and (b) a seat having an opening, wherein the seat is attached to both the left horizontal bar and the right horizontal bar of the frame via an attachment means;

wherein the length of the rear legs, as measured from the top end to the bottom end, are less than the length of the front legs, as measured from the top end to the bottom end; wherein the length of the front left leg and the length of the front right leg can be adjusted and wherein the length of the left side horizontal bar and the length of the right side horizontal bar can be adjusted so as to position said seat in a horizontal plane with said seat opening in alignment with a seat opening of the portable restroom.

2. The portable seat device of claim 1, wherein the front left leg and the front right leg comprise a tubular bottom portion for inserting into a hollow tubular top portion for enabling the length of the legs to be adjusted.

3. The portable seat device of claim 2, wherein a plurality of apertures are disposed along the top portion of the front left leg and the front right leg.

4. The portable seat device of claim 2, wherein a spring-loaded button is disposed on the bottom portion of the front left leg and the front right leg.

5. The portable seat device of claim 1, wherein the left side horizontal bar and right side horizontal bar comprise a tubular inner portion for inserting into a hollow tubular outer portion for enabling the length of the horizontal bars to be adjusted.

6. The portable seat device of claim 5, wherein a plurality of apertures are disposed along the hollow tubular outer portions of the left side horizontal bar and right side horizontal bar.

7. The portable seat device of claim 5, wherein a spring-loaded button is disposed on the hollow tubular inner portion portions of the left side horizontal bar and right side horizontal bar.

8. The portable seat device of claim 1, wherein the front legs can be folded underneath the horizontal bars via a hinge mechanism disposed near the top end of the front left leg and the front right leg.

* * * * *